US005697575A

United States Patent [19]

Moore et al.

[11] Patent Number: 5,697,575

[45] Date of Patent: Dec. 16, 1997

[54] VERTICAL SPLICER

[76] Inventors: Chester W. Moore; Leonard Immanuel Tafel, II, both of c/o Enkel Corporation, 8155 Burden Rd., Rockford, Ill. 61132-2902

[21] Appl. No.: 641,885

[22] Filed: May 2, 1996

Related U.S. Application Data

[63] Continuation of Ser. No. 431,707, Apr. 28, 1995, abandoned.

[51] Int. Cl.[6] ..... B65H 19/12; B65H 19/18

[52] U.S. Cl. ..... 242/555.3; 242/559.4

[58] Field of Search ..... 242/551, 552, 242/555.3, 555.4, 559.1, 559.4; 156/502, 504

[56] References Cited

U.S. PATENT DOCUMENTS

| | | | |
|---|---|---|---|
| 13,671 | 10/1855 | Winder . | |
| 964,546 | 7/1910 | Pfister . | |
| 1,085,909 | 2/1914 | Hoe . | |
| 1,402,989 | 1/1922 | Wood | 242/555.3 |
| 1,409,659 | 3/1922 | Brewer . | |
| 1,716,511 | 6/1929 | Ball | 242/555.3 |
| 1,742,029 | 12/1929 | Fallot | 242/559.4 |
| 1,807,813 | 6/1931 | White | 242/555.4 |
| 1,812,742 | 6/1931 | Fallot . | |
| 1,874,904 | 8/1932 | Crafts . | |
| 1,908,121 | 5/1933 | Crafts . | |
| 1,949,238 | 2/1934 | Broadmeyer . | |
| 2,033,799 | 3/1936 | Wood . | |
| 2,086,144 | 7/1937 | Wood | 242/555.3 |
| 2,094,896 | 10/1937 | Knowlton . | |
| 2,212,812 | 8/1940 | Horton . | |
| 2,389,443 | 11/1945 | Lyle . | |
| 2,601,071 | 6/1952 | Tollison . | |
| 2,622,816 | 12/1952 | Koch . | |
| 3,197,017 | 7/1965 | Ungerer . | |
| 3,327,959 | 6/1967 | Link et al. | 242/555.3 |
| 3,831,876 | 8/1974 | Phelps et al. . | |
| 3,920,502 | 11/1975 | Tokuno | 242/555.4 |
| 4,077,580 | 3/1978 | Lang et al. . | |
| 4,084,761 | 4/1978 | Kuckhermann . | |
| 4,098,468 | 7/1978 | Skalleberg . | |

(List continued on next page.)

FOREIGN PATENT DOCUMENTS

| | | | |
|---|---|---|---|
| 3207366 | 9/1983 | Germany | 242/559.4 |

*Primary Examiner*—John M. Jillions
*Attorney, Agent, or Firm*—Wood, Phillips, VanSanten, Clark & Mortimer

[57] ABSTRACT

A web splicer consists of framework which supports a pair of vertical rails each having a pair of tracks. The rails are spaced horizontally along a center line. One of the rails moves vertically. Travelling up and down the tracks formed into the rails are chucks in bearing support blocks. Motor drives rotate the chucks after they are engaged with a roll of web. A dancer roller and splicing head are of customary construction. Particularly, the framework and associated drives raises at least one of the rails so that it may be raised and lowered, while constraining the rail to move vertically and at a constant distance from the opposite rail. Each rail guides a pair of bearing support blocks, one on each of its tracks, which can independently travel the vertical length of the rail. Each bearing support block rotatably supports a roll core chuck that can be extended in a direction parallel to the center line of the framework and towards an opposing chuck mounted on the opposite rail, so disposed so that the two pairs of chucks may be extended in the hollow core of an interposed roll of web. After the chucks are extended into the roll, motorized lifting mechanism raises the opposing bearing blocks in unison along the tracks. After the roll is lifted the dolly which conveyed it to the splicer is removed. As an expiring roll unwinds and its diameter is thereby reduced, it is raised up near the top of the rails. The one movable rail is then raised up sufficiently to allow a dolly containing a new roll to be inserted underneath the bottom end of the rail. The new roll is positioned offset to the opposite side of the center line from the expiring roll, where it is received by a second pair of chucks which are able to travel down the rail past the first pair.

16 Claims, 7 Drawing Sheets

U.S. PATENT DOCUMENTS 4,173,314 11/1979 Curran et al. .
4,278,213 7/1981 Rubruck .
4,564,150 1/1986 Keene et al. ..... 242/555.3
4,715,922 12/1987 Hayashi et al. .
4,729,519 3/1988 Tafel et al. .
4,729,522 3/1988 Tafel et al. .
4,763,851 8/1988 Flament .
4,792,103 12/1988 Schoonderbeek ..... 242/552
4,821,973 4/1989 Tafel et al. .
4,951,894 8/1990 Young, Jr. et al. .

VERTICAL SPLICER

This is a continuation of application Ser. No. 08/431,707 filed Apr. 28, 1995, now abandoned.

FIELD OF THE INVENTION

The present invention relates generally to the process of splicing a standby web to an active web running through a web processing line, such as when the supply of active web on a roll is nearly exhausted. More particularly, this invention is directed toward loading a standby roll of web to the splicer from an axial direction.

BACKGROUND OF THE INVENTION

An exemplary system for handling web material, such as paper, is shown in U.S. Pat. No. 4,564,150 to Keene et al., issued Jan. 14, 1995, to the assignee hereof.

In the web handling system of the '150 patent, a web is drawn off an active roll by a printing press or the like, and a web drawn from a standby roll is spliced to the active web just before the supply of active web is exhausted. The standby roll then becomes the active roll and a new standby roll is loaded into the system. A new roll is loaded onto a carrier from above and to one side of the splicing station tangential to an axis of the active web. The new roll is supported to advance from a loading station to a splicing station and then to a running station.

With such a splicing structure access must be available above and to the side of the splicer for loading new rolls. This requires that sufficient space remain clear in the area surrounding the splicer for loading the new rolls. Such a construction may not be suitable to some multiweb presses having web splicers positioned in side-by-side relationship.

The present invention is directed to solving one or more of the problems discussed above in a novel and simple manner.

SUMMARY OF THE INVENTION

In accordance with the invention there is disclosed a vertical splicer which loads a standby roll of web from an axial end of a splicer to provide a compact structure.

Broadly, there is disclosed herein a web splicer for splicing a leading edge of a standby roll of web to a trailing end portion of an active web running through a web processing line. The splicer includes a frame supportable on a support surface and defining a first frame axial end and a second frame axial end. A first support mounted to the frame proximate the first frame axial end supports a first vertical rail. A second support mounted to the frame proximate the second frame axial end supports a second vertical rail. First and second core chuck assemblies are mounted at opposite sides of the first vertical rail, each for operatively engaging a core of a roll of web having an axis extending from the first frame axial end to the second frame axial end. Third and fourth chuck assemblies are mounted at opposite sides of the second vertical rail, each for operatively engaging a core of a roll of web having an axis extending from the first frame axial end to the second frame axial end. The first core chuck assembly is aligned with the third core chuck assembly and the second core chuck assembly is aligned with the fourth core chuck assembly. First drive means operatively associated with the first core chuck assembly and the third core chuck assembly controllably, vertically move the first core chuck assembly in unison with the third core chuck assembly to position a roll of web. Second drive means operatively associated with the second core chuck assembly and the fourth core chuck assembly controllably, vertically move the second core chuck assembly in unison with the fourth core chuck assembly to position another roll of web. A splice head assembly is mounted to the frame to splice a web from one of the rolls of web to the other of the rolls of web. A raising means is operatively associated with the first support to raise the associated first vertical rail to load a new roll of web from the first frame axial end to supply a new standby roll of web.

The splicer embodiment consists of framework which supports a pair of vertical rails each having a pair of tracks. The rails are spaced horizontally along a center line. One of the rails moves vertically. Travelling up and down the tracks formed into the rails are chucks in beaRing support blocks. Motor drives rotate the chucks after they are engaged with a roll of web. A dancer roller and splicing head are of customary construction.

Particularly, the framework and associated drives raises at least one of the rails so that it may be raised and lowered, while constraining the rail to move vertically and at a constant distance from the opposite rail. Each rail guides a pair of bearing support blocks, one on each of its tracks, which can independently travel the vertical length of the rail. Each bearing support block rotatably supports a roll core chuck that can be extended in a direction parallel to the center line of the framework and towards an opposing chuck mounted on the opposite rail, so disposed so that the two pairs of chucks may be extended in the hollow core of an interposed roll of web. After the chucks are extended into the roll, motorized lifting mechanism raises the opposing bearing blocks in unison along the tracks. After the roll is lifted the dolly which conveyed it to the splicer is removed. As an expiring roll unwinds and its diameter is thereby reduced, it is raised up near the top of the rails. The one movable rail is then raised up sufficiently to allow a dolly containing a new roll to be inserted underneath the bottom end of the rail. The new roll is positioned offset to the opposite side of the center line from the expiring roll, where it is received by a second pair of chucks which are able to travel down the rail past the first pair. This construction allows floor loaded splicers which are more compact than existing designs.

Further features and advantages of the invention will be readily apparent from the specification and from the drawing.

DETAILED DESCRIPTION OF THE INVENTION

Figure 1:
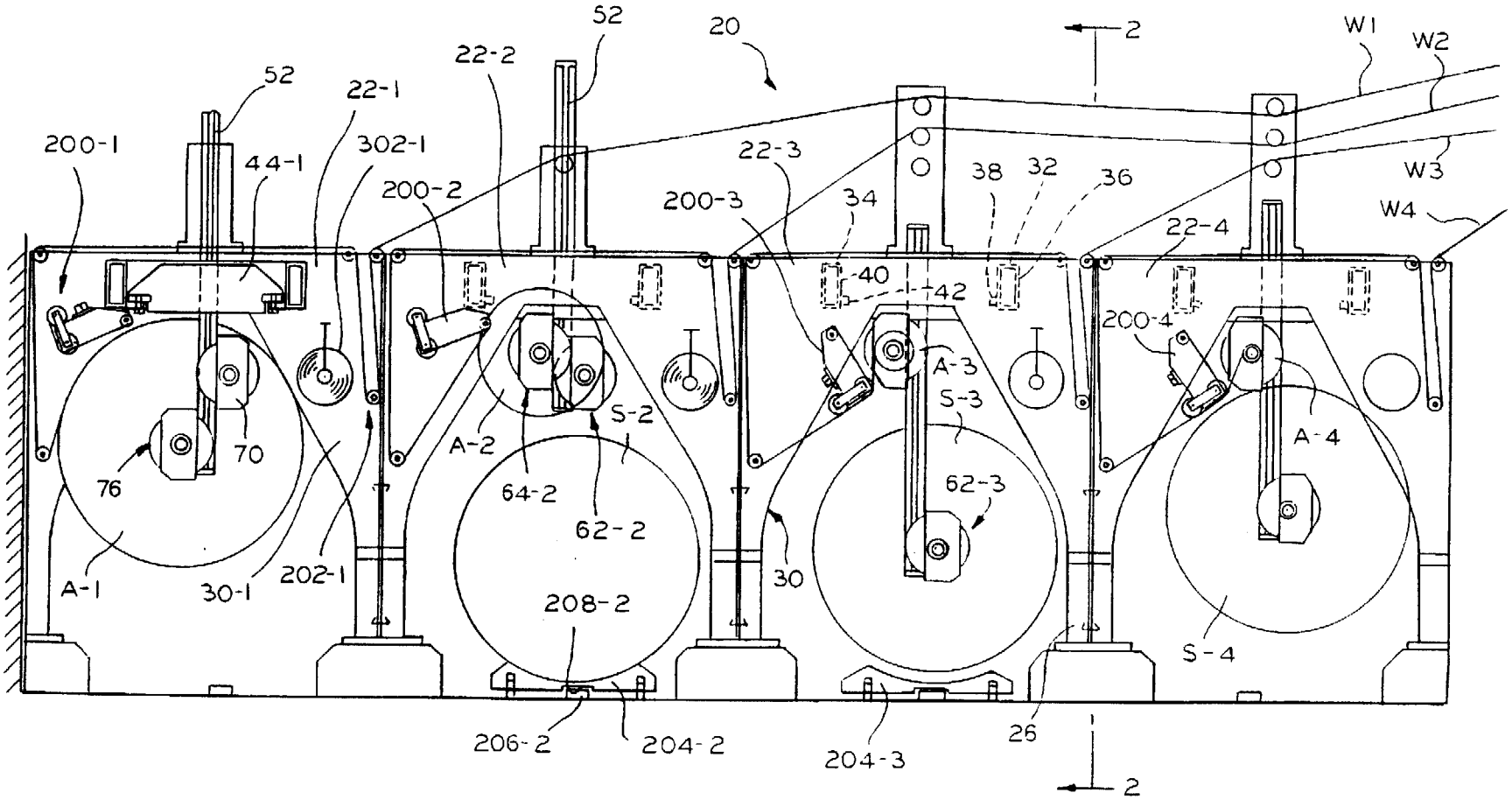
FIG. 1 is an elevation view of four floor loaded splicers according to the invention aligned side-by-side relationship.

Referring initially to FIG. 1, a web handling system 20 supplies webs W1, W2, W3 and W4 as part of a web processing line, such as for a printing press. Each of the webs W1, W2, W3 and W4 is supplied from a respective floor loaded splicer 22-1, 22-2, 22-3 and 22-4 according to the invention. Each of the splicers is generally identical in construction. For simplicity, only one splicer is described in detail herein and is referred to generically with the numeral 22. Likewise, other elements of each splicer are described generically relative to FIGS. 2—10, with an appropriate reference numeral including a hyphen and the suffix 1, 2, 3 or 4 to refer to a specific one of the four splicers 22 in FIG. 1, as will be apparent.

Because of the detailed nature of the splicer 22, some parts are removed in select figures to more particularly illustrate specific other parts. Each of the figures is designed to illustrate particular features of the overall splicer 22, as will be apparent.

Figure 2:
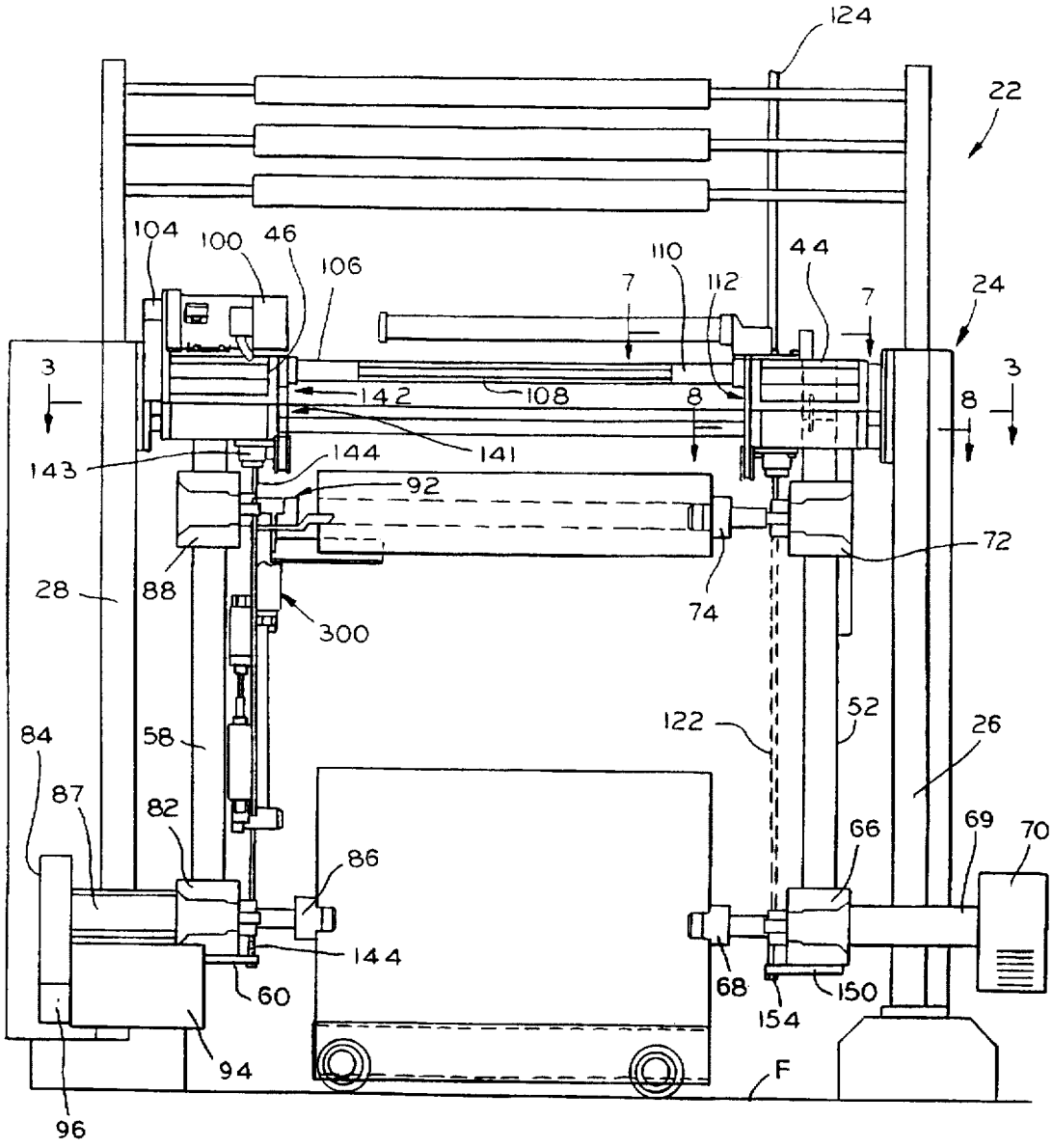
FIG. 2 is a side elevation view of one of the splicers of FIG. 1 taken along the line 2—2 of FIG. 1.
Figure 3:
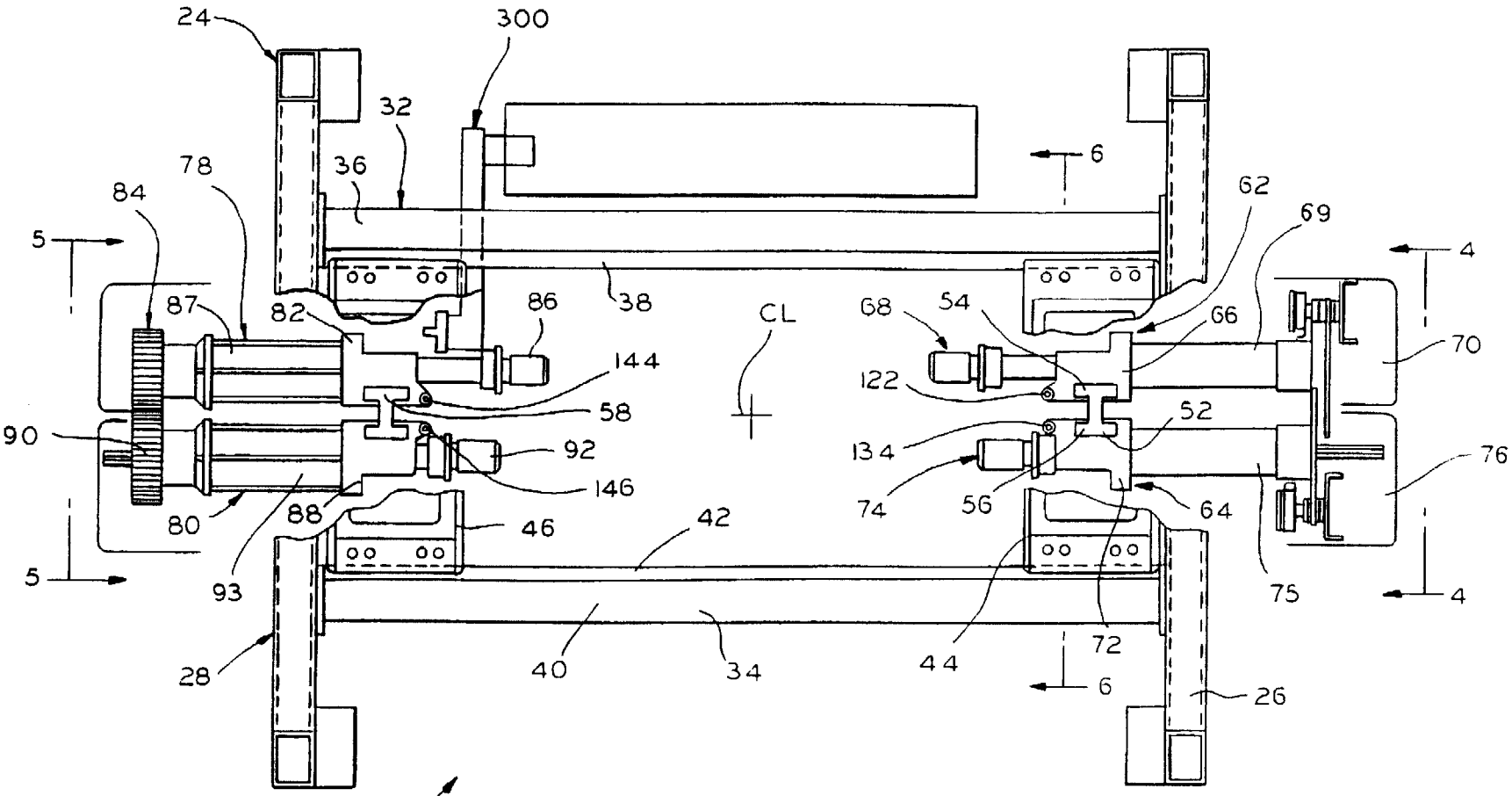
FIG. 3 is a plan view of the splicer taken along the line 3—3 of FIG. 2.

Referring also to FIGS. 2 and 3, the splicer 22 includes a framework 24 consisting of a first or operator side frame axial end 26 and a second or driver side frame axial end 28. Each of the frame axial ends 26 and 28 is supported on a suitable support surface such as a floor F, see FIGS. 1 and 2. As shown in FIG. 1, the operator side frame axial end 26 is generally an inverted U-shape to define an enlarged opening 30. Although not shown, the driver side frame axial end 28 is similarly shaped.

A first cross brace 32 extends between the frame axial end 26 and the frame axial end 28. A second cross brace 34 likewise extends between the frame axial ends 26 and 28 parallel to the first cross brace 32. The cross braces 32 and 34 are affixed to the frame axial ends 26 and 28, above and to either side of the openings, such as the opening 30, see FIG. 1, by any conventional means to provide the fixed framework 24 for supporting the remaining apparatus of the splicer 22.

Figure 4:
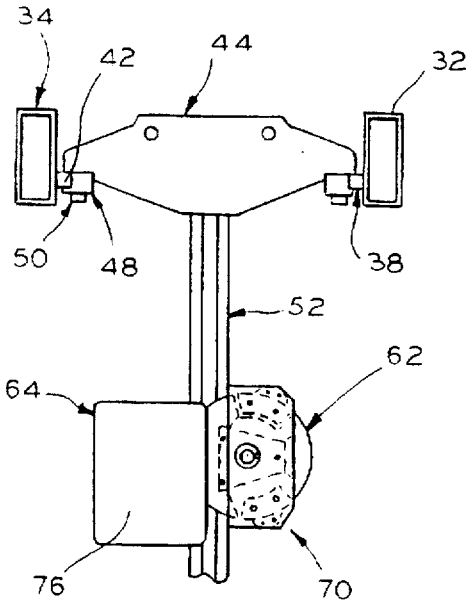
FIG. 4 is a partial elevation view of the rail and bearing support block assembly according to the invention, with parts removed for clarity, taken from an operator side of the splicer generally along the line 4–4 of FIG. 3.

The cross brace 32 comprises a larger rectangular tube 36 having a smaller rectangular tube 38 secured thereto on a side facing the second cross brace 34, see also FIG. 4. Likewise, the second cross brace 34 comprises a larger rectangular tube 40 having a smaller rectangular tube 42 secured thereto on a side facing the first cross brace 32.

The cross braces 32 and 34 mount a first support 44 proximate the operator side frame axial end 26. A second support is mounted between the cross braces 32 and 34 proximate the driver side frame axial end 28. Referring also to FIG. 4, the first support 44 rests atop the smaller rectangular tubes 38 and 42 of the respective cross braces 32 and 34 and are secured thereto using support clamps 48 and clamp bolts 50 on either side. Although not specifically described, the second support 46 is similarly mounted between the cross braces 32 and 34. Thus, the first and second supports 44 and 46 are horizontally adjustable according to a roll width of a roll of web to be mounted thereto. Adjustability is provided by loosening the clamp bolts 50 at either side of each support 44 and 46 and then slidably moving the respective support 44 and 46 either toward or away from the other until they are in a desired axially spaced relationship upon which the clamp bolts 50 are tightened to maintain the supports 44 and 46 in the desired position.

A first H-shaped vertical rail 52 is movably mounted relative to the first support 44, as described below. The rail 52 defines a first track 54 and an opposite second track 56. A second H-shaped vertical rail 58, similar to the rail 52, is fixedly mounted to and depends downwardly from the second support 46. A bottom end of the second rail 58 is secured to a horizontal plate 60, see FIG. 2.

First and second core chuck assemblies 62 and 64 are mounted at opposite sides of the first vertical rail 52. Particularly, the first core chuck assembly 62 is mounted to the first track 54, while the second core chuck assembly 64 is mounted to the second track 56. Each chuck assembly 62 and 64 is vertically movable on the vertical rail 52, as described below.

The first core chuck assembly 62 comprises a bearing support block 66 which rotatably supports a roll core chuck 68 that can be extended by an extending mechanism 69 in a direction parallel to an axial center line, labeled CL, of the frame 24. A caliper brake 70 is mounted to the extending mechanism 69. The second core chuck assembly 64 includes a similar bearing support block 72 mounting a second core chuck 74, extending mechanism 75 and caliper brake 76. In FIG. 3, the first core chuck 68 is illustrated in an extended position with a flex element for gripping a roll of web shown expanded. The second core chuck 74 is shown in a retracted position with a flex element shown contracted.

Third and fourth core chuck assemblies 78 and 80 are mounted at opposite sides of the second rail 58, each for operatively engaging a core of a roll of web. The third core chuck assembly 78 is aligned with the first core chuck assembly 62 and the fourth core chuck assembly 80 is aligned with the second core chuck assembly 64. The third core chuck assembly 78 includes a bearing support block 82 which can move vertically up and down the second rail 58 and supports a drive pulley 84 driving a third core chuck 86 though an extending mechanism 87. Likewise, the fourth core chuck assembly 80 includes a bearing support block 88 which can move up and down the second rail 58 and supports a drive pulley 90 driving a fourth core chuck 92 through an extending mechanism 93. In FIG. 3, the third core chuck 86 is illustrated in an extended position with a flex element for gripping a roll of web shown expanded. The fourth core chuck 92 is shown in a retracted position with a flex element shown contracted.

The drive pulley 84 is driven by a motor 94 through a belt 96, see FIG. 2. A similar motor 98, shown in FIG. 5, drives the pulley 90.

In use, a core of a roll of web can be secured between the first chuck 68 and the third chuck 86 or between the second chuck 74 and the fourth chuck 92. The drive motor 94 is used to rotatably drive the former and the drive motor 90 is used to drive the latter. Likewise, the brake 70 is used to stop the former and the brake 76 is used to stop the latter.

As discussed above, the first vertical rail 52 guides the bearing support blocks 66 and 72, on its respective tracks 54 and 56. The blocks 66 and 72 independently travel the vertical length of the rail 52. Likewise, the second vertical rail 58 guides the bearing support blocks 82 and 88 which can independently travel the vertical length of the second vertical rail 58. Each of the core chucks 68, 74, 86 and 92 can be of conventional construction and be extended and retracted in any known manner in a direction parallel to the center line CL of the framework 24 and towards its opposing chuck mounted on the opposite rail, so disposed that the two pair of chucks may be extended into the hollow core of an interposed roll of web.

Figure 5:
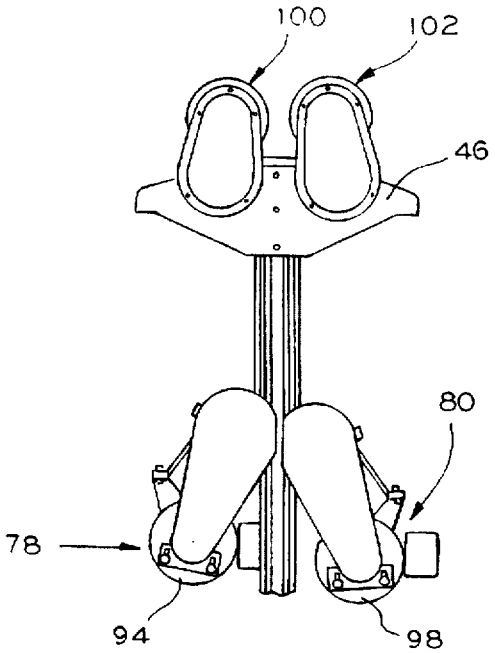
FIG. 5 is a partial elevation view of the rail and bearing support block assembly according to the invention, with parts removed for clarity, taken from a driver side of the splicer generally along the line 5—5 of FIG. 3.
Figure 7:
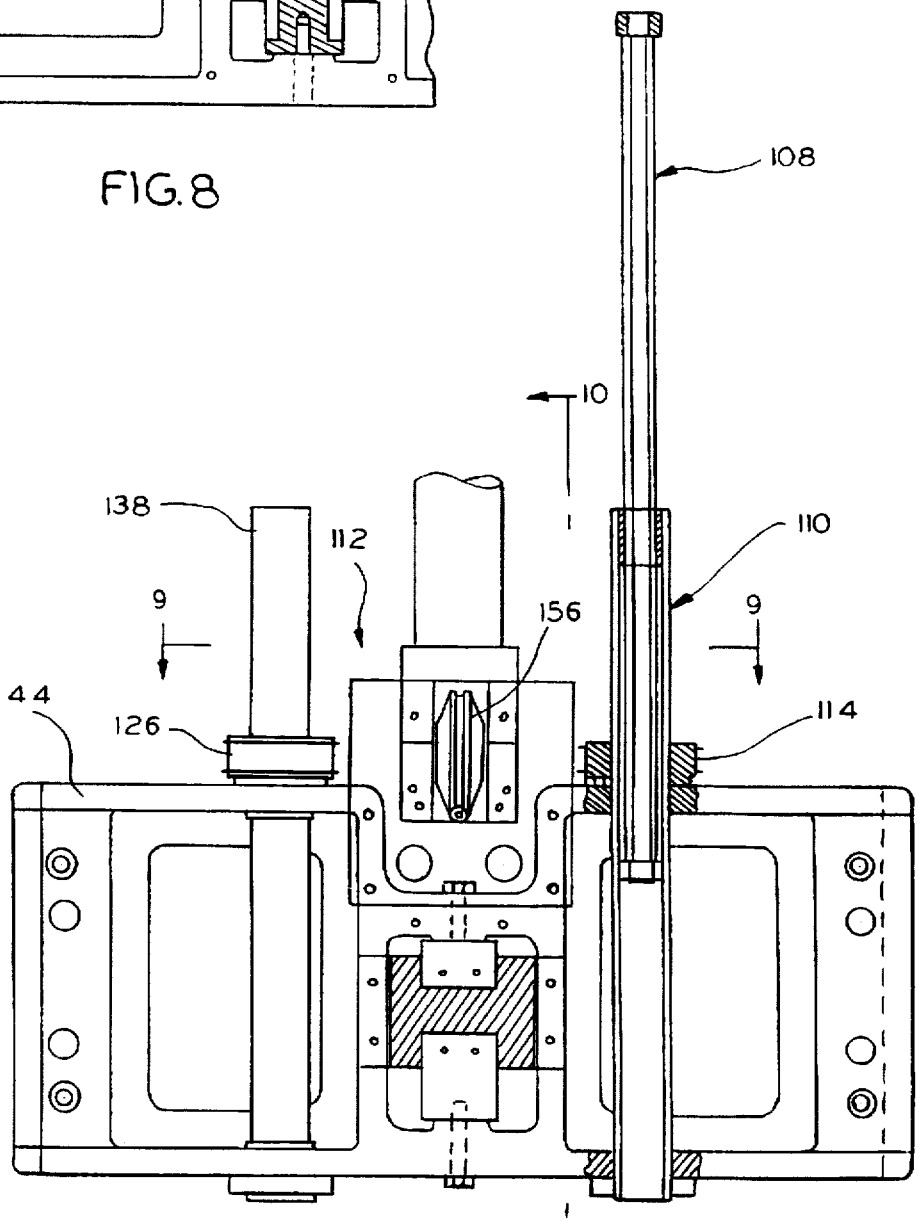
FIG. 7 is a partial plan view taken along the line 7—7 of FIG. 2.
Figure 9:
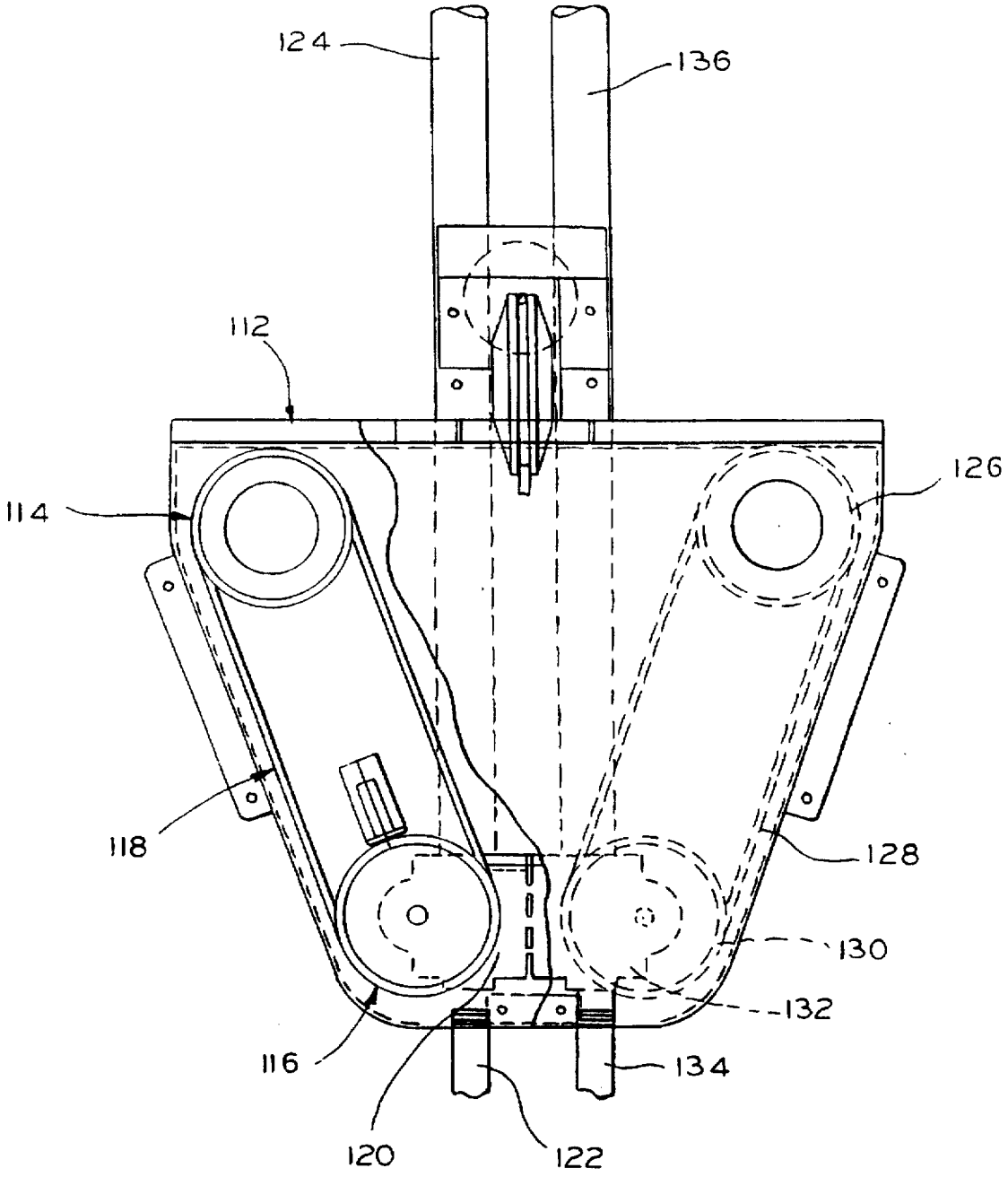
FIG. 9 is a partial elevation view taken along the line 9—9 of FIG. 7.

In order to raise and lower respective core chuck assemblies, a pair of lifting motors 100 and 102 are mounted to the second support 46, see FIG. 5. The lifting motor 100 drives a pulley 104 which rotatably drives a drive tube 106 having a hexagonal opening receiving a hexagonal cross-shaft 108, see FIG. 2. An opposite end of the cross-shaft 108 is received in a hexagonal opening of a driven tube 110, see also FIG. 7. The driven tube 110 is associated with a drive assembly 112 associated with the first support 44. The drive assembly 112 is particularly illustrated in FIG. 9. The driven tube 110 drives a pulley 114 which in turn drives another pulley 116 through a belt 118. The pulley 116 is connected through a gear box 120 for rotating a vertical screw shaft 122. Particularly, the gear box 120 includes an internal output nut (not shown) threadably receiving the threaded screw shaft 122 and which is turned to raise or lower the screw shaft 122. The screw shaft 122 is enclosed in a tube 124 extending above the support 44. The tube 124 acts as a dust cover for the screw shaft 122. The drive assembly 112 includes an additional pulley 126, opposite the pulley 114, for driving via a belt 128 a pulley 130 associated with a gear box 132 for rotating a second screw shaft 134 enclosed in a tube 136. The gear box 132 and shaft 134 are similar to the previously described gear box 120 and screw shaft 122. The pulley 126, which is also shown in FIG. 7, is driven by a driven tube 138, similar to the driven tube 110, discussed above. Although not shown, the driven tube 138 is similarly driven by a hexagonal cross-shaft operatively driven by the second lifting motor 102 of FIG. 5.

Figure 6:
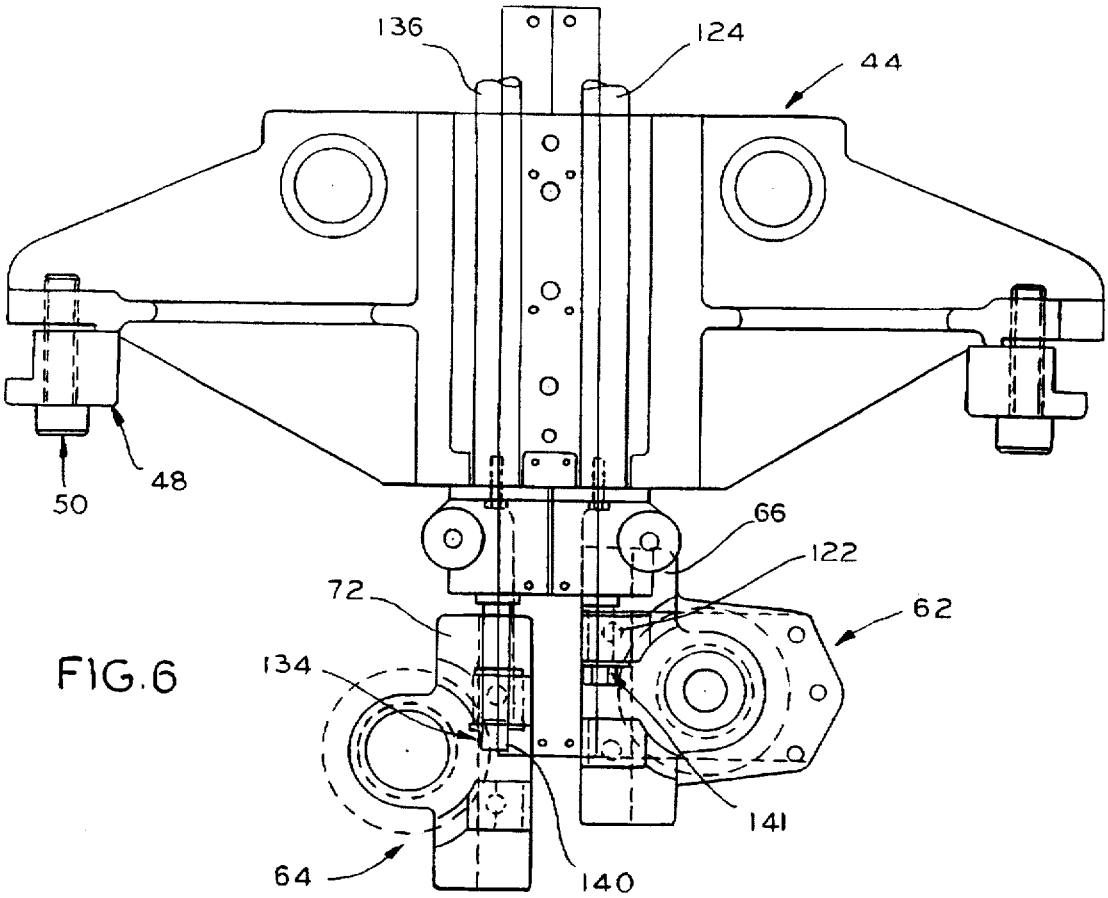
FIG. 6 is a sectional view taken along the line 6—6 of FIG. 3.
Figure 8:
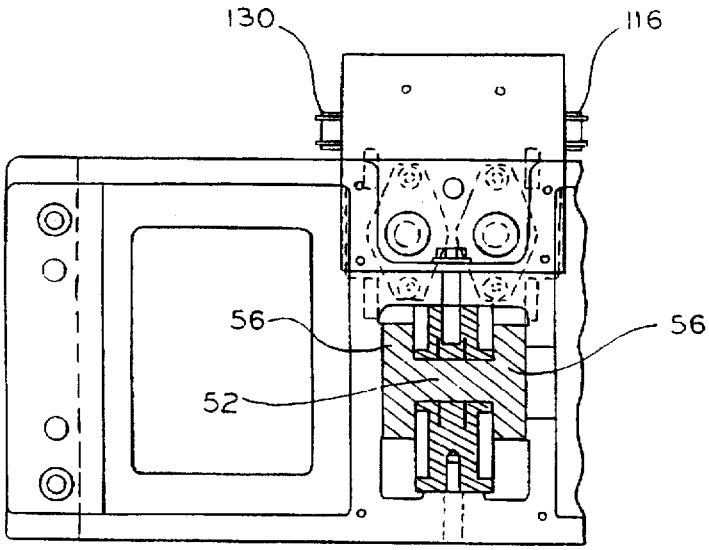
FIG. 8 is a partial plan view taken along the line 8—8 of FIG. 2.
Figure 10:
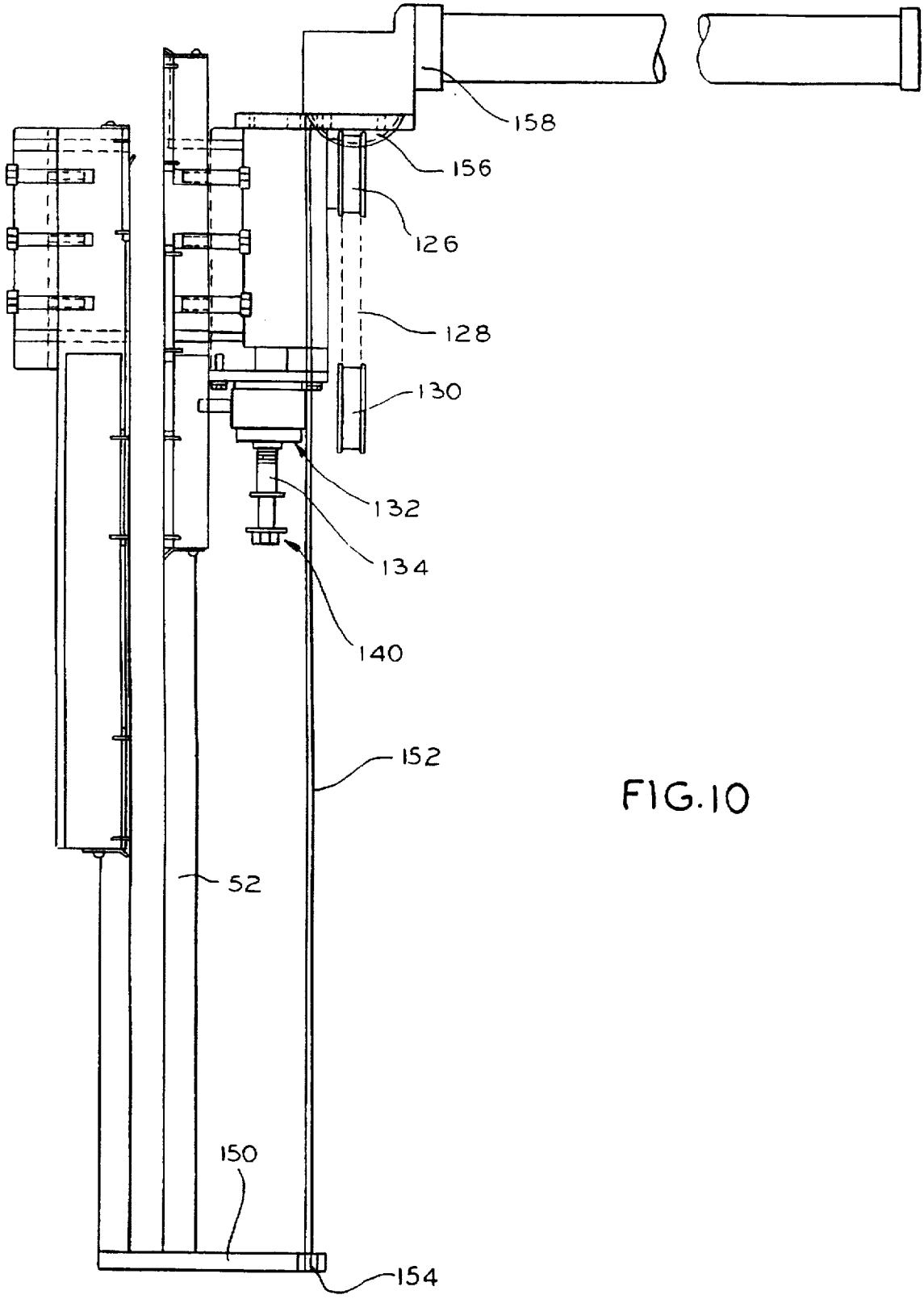
FIG. 10 is a partial elevation view taken along the line 10—10 of FIG. 7.

As best seen in FIG. 10, a nut 140 is threaded onto the bottom end of the screw shaft 134. A similar nut 141 is threaded to the bottom of the screw shaft 122, see FIG. 6. The first screw shaft 122 extends through the first bearing support block 66, see FIG. 3, and is secured with the nut 141. The second screw shaft 134 extends through the second bearing support block 72 and is secured with the nut 140. Thus, rotational movement of the cross-shaft 108, as commanded by operation of the first lifting motor 100, is translated through the pulley 118 and gear box 120 to rotate and raise or lower the screw shaft 122 to in turn raise or lower the first support block 66, see FIG. 6. Likewise, operation of the second lifting motor 102 is translated through a cross-shaft (not shown) to drive the belt 128, and thus gear box 132, to turn and raise or lower the screw shaft 134 to in turn raise or lower the second support block 72 independently of the first support block 66. The ability to independently raise and lower the first and second core chuck assemblies 62 and 64 is best illustrated in FIG. 6 showing the screw shaft 122 and thus assembly 62 at a higher elevational position than the screw shaft 134 and thus assembly 64.

A second drive assembly 142, generally similar to the first drive assembly 112, is mounted to the second support 46, see FIG. 2. The second drive assembly 142 drives screw shafts 144 and 146 for raising and lowering the respective third and fourth bearing support blocks 82 and 88, see FIG. 3. The screw shaft 144 is driven by the lifting motor 100 through the drive shaft 106 and a pulley arrangement 141 to a gear box 143. The screw shaft 146 is driven similarly by the lifting motor 102. The gear box 143, and the gear box (not shown) for the screw shaft 146, are similar to the gear boxes 120 and 132, discussed above, except for having output elements directly affixed to the screw shafts 144 and 146. Thus the shafts 144 and 146 are rotated but not raised or lowered. Therefore, room need not be provided above the support 146 for dust tubes for the shafts 144 and 146. The third screw shaft 144 is received in an internal nut (not shown) in the third bearing support block 82. The fourth screw shaft 146 is received in an internal nut (not shown) in the fourth bearing support block 88. Bottom ends of the screw shafts 144 and 146 bear on the plate 60, see FIG. 2. Thus rotation of the third screw shaft 144 causes the third bearing support block 82 to move up or down the vertically fixed screw shaft 144. Rotation of the fourth screw shaft 146 causes the fourth bearing support block 88 to move up or down the vertically fixed screw shaft 146.

As such, operating the first lifting motor 100 drives the first core chuck assembly 62 in unison with the third core chuck assembly 78 so that the respective core chucks 68 and 86 are in axial alignment. Likewise, the second lifting motor 102 drives the second core chuck assembly 64 in unison with the fourth core chuck assembly 80 so that the associated second core chuck 74 is driven in unison with the fourth core chuck 92 to be in axial alignment therewith.

Referring also to FIG. 10, the first vertical rail 52 is supported on a horizontal plate 150. A cable 152 has an end 154 fastened by any known means to the plate 150. The cable 152 is received about a pulley 156 forming part of a horizontal air cylinder 158. The horizontal air cylinder 158 is of conventional construction and is operable to draw the cable 152 into the air cylinder 158. Thus, the air cylinder 158 biases the plate 150, and thus the first rail 52, upwardly to a raised position.

The plate 150 is of a size so that it extends in a space beneath the first and second bearing support blocks 66 and 72. Thus, the lowermost of the two bearing support blocks, the bearing support block 66 in FIG. 2, will rest atop the plate 150. As discussed above, the vertical position of the support block 66 is determined by the screw 122. As the bearing support block 66, or the bearing support block 72, is driven downward, then the lowermost of the blocks will drive the plate 150 downward against the bias of the air cylinder 158. Because the plate 150 is secured to the lower end of the first rail 52, doing so lowers the first vertical rail 52 to a position necessary for the requirements of the associated core chuck assembly 62 or 64.

The operation of the splicer 22 is now described in connection with the individual splicers 22-1, 22-2, 22-3 and 22-4 shown in FIG. 1.

Each of the splicers 22 includes a splicehead assembly 200 of conventional construction. The splicehead assembly 200 is mounted to the frame 24 of the associated splicer 24 between a neutral position, see 200-1 and 200-2, and an operative position, see 200-3 and 200-4. The particular configuration of the splicehead assembly 200 is conventional in construction and does not form part of the invention.

In accordance with the invention, the pairs of core chuck assemblies 62 and 78 and 64 and 80 can be used to position respective first and second rolls of web, as will be described. Particularly, the first and third core chuck assemblies 62 and 78 support a web offset to the right of centerline CL of the splicer when viewed from the operator side defined by the operator side frame axial end 26. The second and fourth core chuck assemblies 64 and 80 support a second roll of web to the left of the centerline CL when viewed from the operator side frame axial end. These positions are referred to hereinbelow as the respective right offset position and left offset position in FIG. 1.

As illustrated in FIG. 1, the first splicer 22-1 supports an active roll of web A-1 in the left offset position during a run mode. The active roll A-1 is being raised as it expires by operation of the second lifting motor 102 in any known manner. The web is directed around appropriate spools and a dancer 202-1, as shown. The splicehead 200-1 is in the neutral position. A butt or empty roll in the rightmost position can be removed anytime after the prior splice by a roll retrieval mechanism 300, see FIGS. 2 and 3, not forming part of the present invention. The spent core can be removed through an opening 302-1 in the frame end 30-1.

In the illustrated embodiment of the invention, the splicers 22 are adapted for use with rolls up to fifty inches in diameter. Referring to the second splicer 22-2, a new fifty inch standby roll S-2 can be loaded after the active roll A-2 reaches twenty-six inches diameter or less. As can be seen, the first vertical rail 52 is raised automatically, as discussed above, as the second core chuck assembly 64-2 is raised until it is stopped by the then stationary first core chuck assembly 62-2. At this time, the vertical rail 52 is at a high enough position to permit entry of a standby roll S-2 which is mounted on a dolly 204-2. The dolly 204-2 includes a central slot 208-2 on its underside. The slot 208-2 is aligned with a roll dolly guide 206-2. The guide 206-2 can be selectively positioned in a righthand position, as shown, to load a roll in the right offset position, or a lefthand position, see the fourth splicer 22-4, to load a roll in the left offset position.

The third splicer 22-3 illustrates the loading of a standby roll S-3 into the right offset position. Particularly, the first core chuck assembly 62-3 is lowered, as discussed above, by the first raising motor 100 along with the corresponding third core chuck assembly 78-3 (not shown) until the core chuck assemblies are aligned with a center of the standby roll S-3. At that time, the core chucks are extended and the related flex elements expanded, as discussed above, to secure the roll S-3 thereon. The standby roll S-3 is then elevated slightly by operating the first lifting motor 100 to lift the roll S-3 off the dolly 204-3. The dolly 204-3 can be removed. The splicehead assembly 200-3 rotates into position with the web from the active roll A-3.

The splicing operation is illustrated with the fourth splicer 22-4. The motor 94 for the splicer 22-4 begins turning the standby roll S-4 up to speed in preparation for a splice which proceeds according to conventional practice. Particularly, the splicehead assembly 200-4 splices the leading edge of the web on the standby roll S-4 to the web from the active roll A-4. The standby roll then becomes the active roll and the spent core or butt in the left offset position can then be removed by the roll retrieval mechanism 300 until a standby roll is subsequently loaded in the left offset position in the same manner as with the right offset position as discussed above.

Thus, in accordance with the invention a vertical splicer is provided in which a standby roll can be loaded in an axial direction. This is accomplished by raising one of the vertical rails to allow a dolly containing a new roll to be inserted underneath the bottom end of the rail. This construction provides floor loaded splicers which are more compact than existing designs and permits the splicers to be positioned in side-by-side relationship in a web processing system plant floor.

We claim:

1. A web splicer for splicing a leading edge of a standby roll of web to a trailing end portion of an active web running through a web processing line, comprising:

a frame supportable on a support surface and defining a first frame axial end and a second frame axial end;

a first support mounted to the frame proximate the first frame axial end supporting a first vertical rail;

a second support mounted to the frame proximate the second frame axial end supporting a second vertical rail;

first and second core chuck assemblies mounted at opposite sides of the first vertical rail, each for operatively engaging a core of a roll of web;

third and fourth core chuck assemblies mounted at opposite sides of the second vertical rail, each for operatively engaging a core of a roll of web, said first core chuck assembly being aligned with the third core chuck assembly and the second core chuck assembly being aligned with the fourth core chuck assembly;

first drive means operatively associated with the first core chuck assembly and the third chuck assembly for controllably, vertically moving the first core chuck assembly in unison with the third core chuck assembly to position a first roll of web;

second drive means operatively associated with the second core chuck assembly and the fourth chuck assembly for controllably, vertically moving the second core chuck assembly in unison with the fourth core chuck assembly to position a second roll of web;

a splice head assembly mounted to the frame to splice a web from either the first or second roll of web to the other of the first and second roll of web; and raising means operatively associated with either the first support or the second support to raise the associated first or second vertical rail to load a new roll of web from either the first frame axial end or the second frame axial end, respectively.

2. The web splicer of claim 1 wherein each of the first drive means and the second drive means comprises a lifting motor driving a pair of screw shafts.

3. The web splicer of claim 2 wherein each of the screw shafts is operatively associated with one of the core chuck assemblies, each screw shaft raising or lowering its associated core chuck assembly in response to being driven by its associated lifting motor.

4. The web splicer of claim 2 wherein each lifting motor drives a cross shaft extending between the first frame end and the second frame end, and each cross shaft in turn drives a gear box at each end to drive the pair of screw shafts.

5. The web splicer of claim 4 wherein the cross shaft is drivingly connected to each gear box through a pulley.

6. The web splicer of claim 1 wherein the raising means comprises a plate secured to a lower end of either the first rail or the second rail, and means for biasing the plate upwardly, the plate extending in a space beneath the core chuck assemblies mounted to the secured rail so that a lower of the core chuck assemblies drives the secured rail to a position necessary for requirements of the mounted core chuck assembly.

7. The web splicer of claim 6 wherein the biasing means comprises an air cylinder connected to the plate through a cable, the air cylinder being operable to draw the cable into the air cylinder.

8. A web splicer for splicing a leading edge of a standby roll of web to a trailing end portion of an active web running through a web processing line, comprising:

a frame supportable on a support surface and defining a first frame axial end and a second frame axial end;

a first support means proximate the first frame axial end for supporting first and second core chuck assemblies mounted at opposite sides of the first support means, each for operatively engaging a core of a roll of web;

a second support means proximate the second frame axial end for supporting third and fourth core chuck assemblies mounted at opposite sides of the second support means, each for operatively engaging a core of a roll of web, said first core chuck assembly being aligned with the third core chuck assembly to position a first roll of web and the second core chuck assembly being aligned with the fourth core chuck assembly to position a second roll of web;

a splice head assembly mounted to the frame to splice a web from either the first or second roll of web to the other of the first and second roll of web; and raising means mounted proximate at least one of the frame axial ends to raise the associated first or second support means to load a new roll of web from either the first frame axial end or the second frame axial end, respectively.

9. The web splicer of claim 8 further comprising first drive means operatively associated with the first core chuck assembly and the third chuck assembly for controllably, vertically moving the first core chuck assembly in unison with the third core chuck assembly to position the first roll of web and second drive means operatively associated with the second core chuck assembly and the fourth chuck assembly for controllably, vertically moving the second core chuck assembly in unison with the fourth core chuck assembly to position the second roll of web.

10. The web splicer of claim 9 wherein each of the first drive means and the second drive means comprises a lifting motor driving a pair of screw shafts.

11. The web splicer of claim 10 wherein each of the screw shafts is operatively associated with one of the core chuck assemblies, each screw shaft raising or lowering its associated core chuck assembly in response to being driven by its associated lifting motor.

12. The web splicer of claim 10 wherein each lifting motor drives a cross shaft extending between the first frame end and the second frame end, and each cross shaft in turn drives a gear box at each end to drive the pair of screw shafts.

13. The web splicer of claim 12 wherein the cross shaft is drivingly connected to each gear box through a pulley.

14. The web splicer of claim 9 wherein the first support means comprises a first vertical rail and the second support means comprises a second vertical rail, the first and second core chuck assemblies being mounted at opposite sides of the first vertical rail, the third and fourth core chuck assemblies being mounted at opposite sides of the second vertical rail.

15. The web splicer of claim 14 wherein the raising means comprises a plate secured to a lower end of either the first rail or the second rail, and means for biasing the plate upwardly, the plate extending in a space beneath the core chuck assemblies mounted to the secured rail so that a lower of the core chunk assemblies drives the secured rail to a position necessary for requirement of the mounted core chuck assembly.

16. The web splicer of claim 15 wherein the biasing means comprises and air cylinder connected to the plate through a cable, the air cylinder being operable to draw the cable into the air cylinder.

* * * * *